US005441315A

United States Patent [19]

Kleefeldt et al.

[11] Patent Number: 5,441,315

[45] Date of Patent: * Aug. 15, 1995

[54] ELECTRIC-MOTOR DRIVE FOR MOTOR-VEHICLE CENTRAL LOCK SYSTEM

[75] Inventors: Frank Kleefeldt; Rolf Schüler, both of Heiligenhaus, Germany

[73] Assignee: Kiekert GmbH & Co. KG, Heiligenhaus, Germany

[ * ] Notice: The portion of the term of this patent subsequent to Sep. 22, 2009 has been disclaimed.

[21] Appl. No.: 67,389

[22] Filed: May 26, 1993

[30] Foreign Application Priority Data

Jul. 16, 1992 [DE] Germany ..... 42 23 341.0

[51] Int. Cl.[6] ..... E05C 3/06

[52] U.S. Cl. ..... 292/201; 292/144; 292/199; 70/264; 70/276; 74/404

[58] Field of Search ..... 292/144, 336.3, 201, 292/199, DIG. 3, DIG. 23, DIG. 25; 70/264, 237, 275, 276, 279–282; 74/86.5, 404, 421 A

[56] References Cited

U.S. PATENT DOCUMENTS

| | | | |
|---|---|---|---|
| 3,397,589 | 8/1968 | Moore | 74/404 X |
| 4,137,789 | 2/1978 | Herleth | 74/404 |
| 4,862,766 | 9/1989 | Molders | 74/404 X |
| 4,974,886 | 12/1990 | Kleefeldt et al. | 70/264 |
| 5,010,750 | 4/1991 | Boser et al. | 70/276 |
| 5,056,343 | 10/1991 | Kleefeldt et al. | 70/264 |
| 5,078,436 | 1/1992 | Kleefeldt et al. | 70/264 X |
| 5,085,090 | 2/1992 | Sugasawa et al. | 74/404 X |
| 5,149,156 | 9/1992 | Kleefeldt | 292/201 X |
| 5,202,580 | 4/1993 | Janssen | 70/276 X |
| 5,271,253 | 12/1993 | Cassada et al. | 70/276 |

FOREIGN PATENT DOCUMENTS

| | | | |
|---|---|---|---|
| 4031579 | 2/1992 | Japan | 70/276 |
| 1594256 | 9/1990 | U.S.S.R. | 70/276 |

*Primary Examiner*—Peter M. Cuomo
*Assistant Examiner*—Suzanne L. Dino
*Attorney, Agent, or Firm*—Herbert Dubno; Andrew Wilford

[57] ABSTRACT

A power actuator used in combination with a motor-vehicle door latch movable between a locked and unlocked position has a housing, a reversible electric motor in the housing having a rotatable output shaft defining an axis, and an input gear on the shaft. A threaded output spindle spaced from the shaft in the housing carries an output gear out of mesh and out of engagement with the input gear. A nut is threaded on the spindle. An actuating element couples the nut with the latch to switch it between its positions. A support pivotal in the housing about the axis carries a pair of coupling gears in mesh with and flanking the input gear. The support is rockable about the axis from a central position in which neither of the coupling gears meshes with the output gear into a pair of end positions in each of which a respective one of the coupling gears meshes with the output gear and couples same to the input gear. The support is biased into the central position with a relatively small force such that on rotation of the input gear in either direction the biasing force is overcome and the support is rocked in the same direction into the respective end position.

5 Claims, 4 Drawing Sheets

ELECTRIC-MOTOR DRIVE FOR MOTOR-VEHICLE CENTRAL LOCK SYSTEM

FIELD OF THE INVENTION

The present invention relates to a motor-vehicle central lock system. More particularly this invention concerns an electric-motor actuator for such a system.

BACKGROUND OF THE INVENTION

A standard central motor-vehicle lock system has a plurality of door latches on the individual doors, hatches, trunk lids, and the like that are each operable by a respective power actuator and also by a manual mechanism. The power actuator can include a hydraulic, pneumatic, or electric motor, and the manual mechanism is almost always a lever linkage.

In a standard system such as described in my U.S. Pat. No. 4,342,209 each door latch has a locking lever displaceable between a pair of end positions corresponding to locked and unlocked conditions of the respective door. This lever is connected on the one side via a rod to the inside unlocking button in the case of a door and on the other side via another rod to the power actuator which is mounted in the door at some distance from the latch. Thus either the knob or the actuator can be operated to lock or unlock the door.

As described in commonly owned U.S. Pat. No. 5,056,343 issued 15 Oct. 1991 the actuator for such a lock system has an electric motor whose output shaft carries a drive pinion that is in continuous mesh with a larger-diameter output gear carried on a threaded spindle in turn carrying a nut. This nut is coupled via a system of deflectable arms to the actuating element. Thus the latch can be moved manually or by the motor between the locked and unlocked position. When moved manually from the locked to the unlocked position, it is necessary for the motor to be operated to move the nut back into the corresponding position before motor-powered operation can resume.

OBJECTS OF THE INVENTION

It is therefore an object of the present invention to provide an improved electric-motor actuator for a central lock system.

Another object is the provision of such an improved electric-motor actuator for a central lock system which overcomes the above-given disadvantages, that is which can switch between manual and power operation with no wasted cycling.

SUMMARY OF THE INVENTION

A power actuator used in combination with a motor-vehicle door latch movable between a locked and unlocked position has according to the invention a housing, a reversible electric motor in the housing having a rotatable output shaft defining an axis, and an input gear on the shaft. A threaded output spindle spaced from the shaft in the housing carries an output gear out of mesh and out of engagement with the input gear. A nut is threaded on the spindle. An actuating element couples the nut with the latch to switch it between its positions. A support pivotal in the housing about the axis carries a pair of coupling gears in mesh with and flanking the input gear. The support is rockable about the axis from a central position in which neither of the coupling gears meshes with the output gear into a pair of end positions in each of which a respective one of the coupling gears meshes with the output gear and couples same to the input gear. The support is biased into the central position with a relatively small force such that on rotation of the input gear in either direction the biasing force is overcome and the support is rocked in the same direction into the respective end position.

With this system, therefore, there is no need to reverse drive the motor so the link parts can reassume the proper position if after power actuation the door lock is operated manually. The power actuator can pick up right where it left off.

According to the invention the housing is of U-section and has a pair of sides and a back bridging the sides. The input and coupling gears are between the sides and the biasing means is braced between the back and the housing. The biasing means can be a spring connected between the support and the housing. Alternately it can include a magnet mounted in the support and a magnet mounted in the housing. When one of the magnets is an electromagnet and is demagnetized the support will stay in its end positions after is moved therein by rotation of the input gear. This can provide a locking or antitheft function, inhibiting manual actuation of the latch until the electromagnet is energized.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
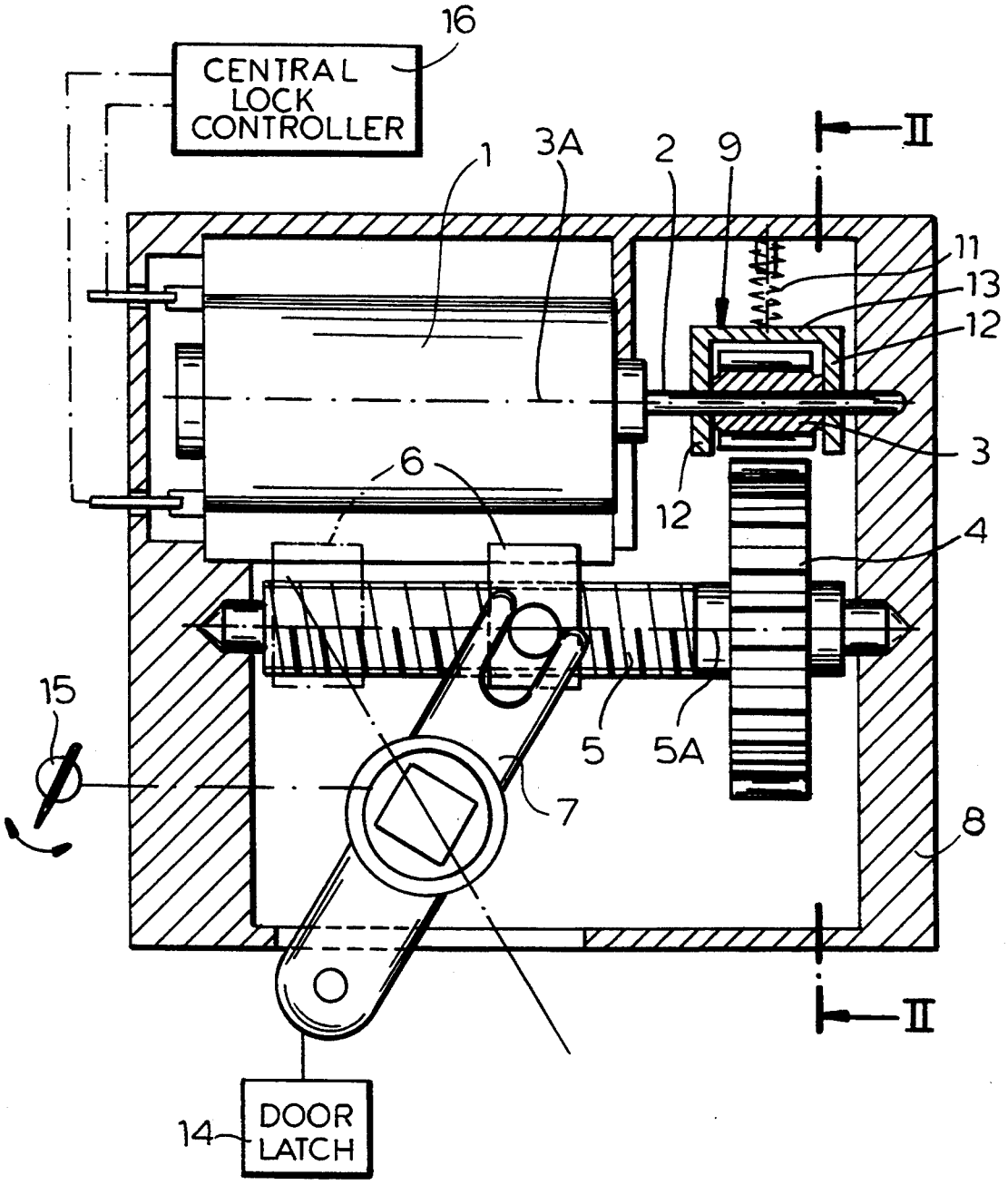
FIG. 1 is a partly diagrammatic section through the actuator of this invention.
Figure 2:
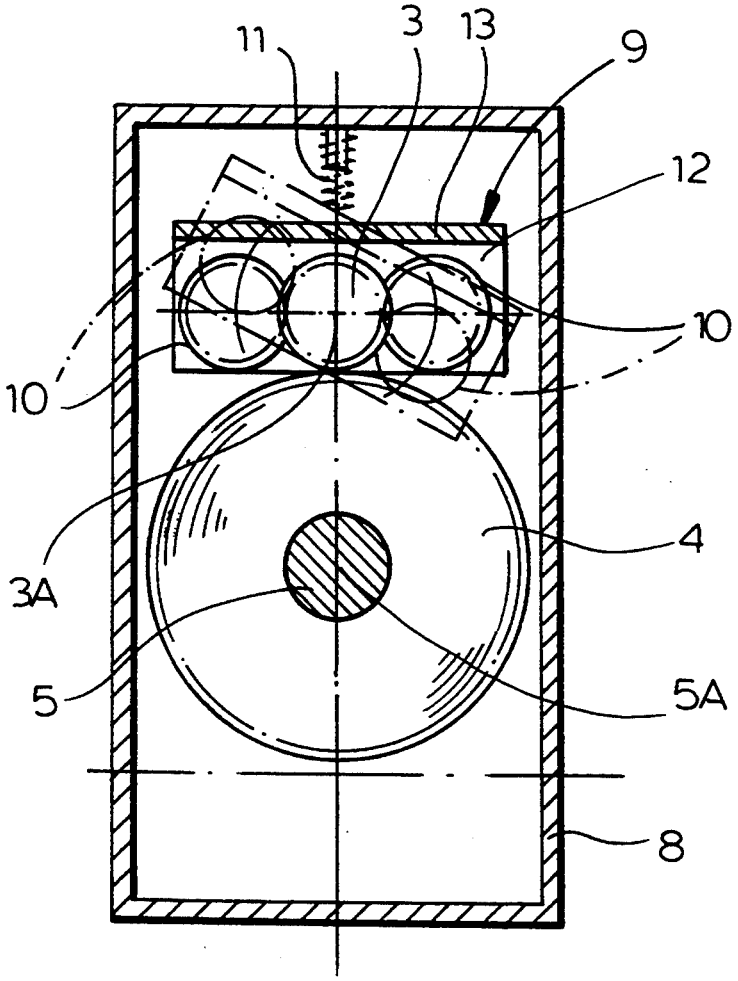
FIG. 2 is a section taken along line II—II of FIG. 1.

As seen in FIGS. 1 and 2 an actuator housing 8 typically mounted in a motor-vehicle door contains a reversible electric motor 1 operated by a central-lock controller 16 and having an output shaft 2 carrying an input gear 3 and centered on an axis 3A. A threaded spindle 5 rotatable in the housing 8 about an axis 5A parallel to the axis 3A carries a large-diameter output gear 4 level with but not meshing with the gear 3 and a nut 6. An operating lever 7 has one end coupled to this nut 6 and an opposite end coupled to a door latch 14. Movement of the lever 7 in one direction unlocks the door latch 14 and in the opposite direction locks it. A manual locking/unlocking element 15 is coupled to the lever 7 so that the door can be locked or unlocked manually.

According to the invention a U-section rocking support 9 is pivotal on the shaft 2 about the axis 3A and carries a pair of small-diameter coupling gears 10 both meshing permanently with the input gear 3 on the shaft 2. The support 9 has a pair of sides 12 between which the gears 10 are journaled and through which the shaft 2 passes and a flat back 13 bridging the cheeks or sides 12. This support 9 can rock between the central position illustrated in solid lines in FIGS. 2 and 4 and a pair of end positions, one illustrated with dot-dash lines in FIGS. 2 and 4. In the central position none of the gears 3 or 10 meshes with the gear 4. In each of the end positions a respective one of the gears 10 meshes with the gear 4, coupling same to the gear 3.

Figure 3:
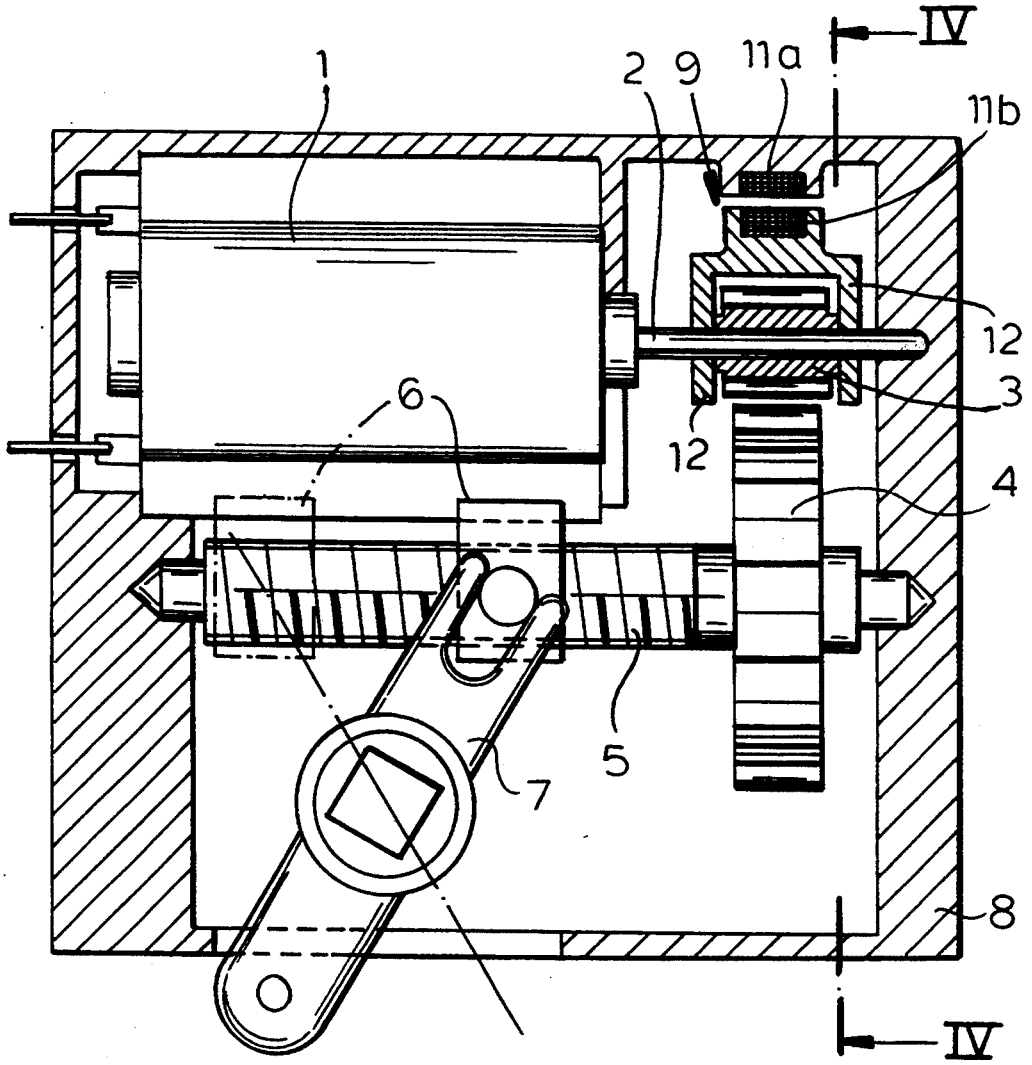
FIG. 3 is a view like FIG. 1 of another actuator according to the invention.
Figure 4:
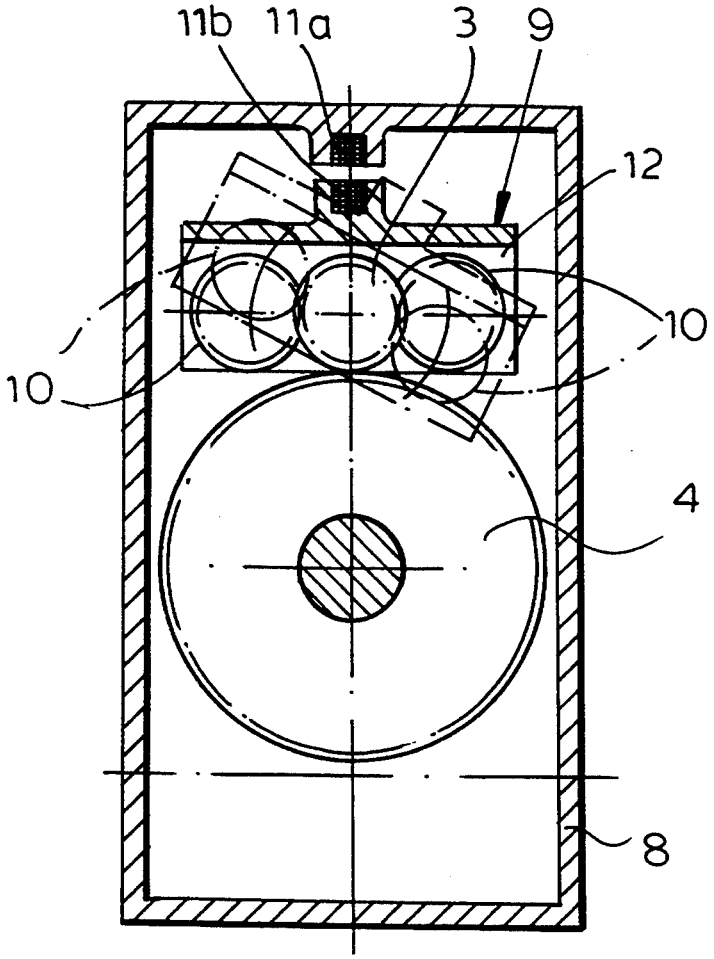
FIG. 4 is a section taken along line IV—IV of FIG. 3.

In FIGS. 1 and 2 a spring 11 urges the support 9 into the central position. In FIGS. 3 and 4 a permanent magnet 11*a* in the housing 8 coacts with an electromagnet 11*b* in the support 9 and connected to the controller 16 so that, when the electromagnet 11*b* is energized, the magnetic attraction urges the support 9 into the central position.

During normal use, when the biasing means 11; 11*a*, 11*b* is operational, rotation of the gear 3 in one direction will cause the entire support 9 to rock in the same direction and both gears 10 will rotate in the opposite direction. One of the gears 10 will engage into the gear 4 and rotate it in the same direction as the gear 3. As soon as the motor 1 stops, the biasing force will pull the meshing gear 10 out of the gear 4 and decouple same from each other.

If in the embodiment of FIGS. 3 and 4 the magnet 11*b* is not energized, the gear 10 will stay in mesh with the gear 4 after operation of the motor 1 and until the motor 1 is reversed. This will provide an antitheft function in that manual operation of the element 15 is impeded since the nut would have to reverse drive the motor 1 through the gear train 4, 10, 3.

We claim:

1. In combination with a motor-vehicle door latch movable between a locked and unlocked position, a power actuator comprising:

a housing;

a reversible electric motor in the housing having a rotatable output shaft defining an axis;

an input gear on the shaft;

a threaded output spindle spaced from the shaft in the housing;

an output gear on the spindle out of mesh and out of engagement with the input gear;

a nut threaded on the spindle;

means including an actuating element operatively coupling the nut with the latch to switch it between its positions;

a support pivotal in the housing about the axis;

a pair of coupling gears on the support in mesh with and flanking the input gear, the support being rockable about the axis from a central position in which neither of the coupling gears meshes with the output gear into a pair of end positions in each of which a respective one of the coupling gears meshes with the output gear and couples same to the input gear; and biasing means urging the support into the central position with a relatively small force such that on rotation of the input gear in either direction the biasing force is overcome and the support is rocked in the same direction into the respective end position.

2. The power actuator defined in claim 1 wherein the housing is of U-section and has a pair of sides and a back bridging the sides, the input and coupling gears being between the sides and the biasing means being braced between the back and the housing.

3. The power actuator defined in claim 1 wherein the biasing means is a spring connected between the support and the housing.

4. The power actuator defined in claim 1 wherein the biasing means includes a magnet mounted in the support and a magnet mounted in the housing.

5. The power actuator defined in claim 4 wherein one of the magnets is an electromagnet, whereby when the one magnet is demagnetized the support will stay in its end positions after being moved therein by rotation of the input gear.

* * * * *